US010030892B2

(12) United States Patent
Morie et al.

(10) Patent No.: US 10,030,892 B2
(45) Date of Patent: Jul. 24, 2018

(54) CRYOGENIC REFRIGERATOR

(71) Applicant: SUMITOMO HEAVY INDUSTRIES, LTD., Tokyo (JP)

(72) Inventors: Takaaki Morie, Tokyo (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 620 days.

(21) Appl. No.: 13/910,203

(22) Filed: Jun. 5, 2013

(65) Prior Publication Data

US 2014/0026596 A1 Jan. 30, 2014

(30) Foreign Application Priority Data

Jul. 27, 2012 (JP) ..... 2012-166642

(51) Int. Cl.
*F25B 9/14* (2006.01)
*F25B 7/00* (2006.01)

(52) U.S. Cl.
CPC ..... *F25B 7/00* (2013.01); *F25B 9/14* (2013.01); *F25B 2500/01* (2013.01)

(58) Field of Classification Search
CPC ..... F25B 9/14; F25B 2500/01
USPC ..... 62/6
See application file for complete search history.

(56) References Cited

U.S. PATENT DOCUMENTS

| | | | | |
|---|---|---|---|---|
| 4,019,336 | A | 4/1977 | Mijnheer et al. | |
| 5,481,879 | A | 1/1996 | Asami et al. | |
| 5,590,533 | A * | 1/1997 | Asami | F17C 3/085 60/520 |
| 2010/0229572 | A1* | 9/2010 | Raiju et al. | 62/6 |

FOREIGN PATENT DOCUMENTS

| | | |
|---|---|---|
| JP | 05-332627 | 12/1993 |
| JP | 2659684 | 9/1997 |
| JP | 2003-314918 | 11/2003 |
| JP | 2004-144461 | 5/2004 |
| JP | 2012-077966 | 4/2012 |

* cited by examiner

*Primary Examiner* — Frantz Jules
*Assistant Examiner* — Brian King
(74) *Attorney, Agent, or Firm* — IPUSA, PLLC

(57) ABSTRACT

A cryogenic refrigerator includes a cylinder, a displacer accommodated in the cylinder so as to reciprocate inside the cylinder with a gap formed between the periphery of the displacer and the interior surface of the cylinder, and a depressed part formed on at least one of the periphery of the displacer and the interior surface of the cylinder. The ratio of the volume of the depressed part to the volume of the gap satisfies a condition of $8 \leq Vd/Vg \leq 75$, where Vd is the volume of the depressed part and Vg is the volume of the gap.

5 Claims, 4 Drawing Sheets

CRYOGENIC REFRIGERATOR

CROSS-REFERENCE TO RELATED APPLICATION

This application is based upon and claims the benefit of priority of Japanese Patent Application No. 2012-166642, filed on Jul. 27, 2012, the entire contents of which are incorporated herein by reference.

BACKGROUND

1. Technical Field

A certain aspect of embodiments discussed herein is related to a cryogenic refrigerator that includes a displacer that has a groove formed on its periphery.

2. Description of the Related Art

In general, refrigerators including a displacer, such as Gifford-McMahon (GM) cycle refrigerators and Stirling cycle refrigerators, are known as cryogenic refrigerators that produce cryogenic temperatures at or below 15 K.

Taking the GM refrigerator as an example, the displacer is so provided in a cylinder as to be able to reciprocate in the cylinder, and an expansion space and a room temperature space are provided at a low temperature end and a high temperature end, respectively, inside the cylinder. Further, a gas passage through which a refrigerant gas (helium gas) flows is provided inside the displacer. This gas passage is filled with a regenerator material, and communicates with the expansion space and the room temperature space.

At the gas supply process, a refrigerant gas is supplied from a compressor to the room temperature space at the high temperature end, and this high-pressure refrigerant gas is introduced into the expansion space through the gas passage inside the displacer. At the gas return process, the refrigerant gas inside the expansion space is returned to the compressor through the same passage.

In this configuration, cold temperatures are produced in the expansion space by optimizing the timing between the reciprocation of the displacer and the supply and return process of the refrigerant gas. The refrigerant gas cooled by the produced cold temperatures cools the regenerator material inside the displacer when the refrigerant gas is returned to the compressor through the displacer at the gas return process. Further, at the gas supply process, the refrigerant gas is introduced into the expansion space after being cooled by the regenerator material.

A gap is formed between the displacer and the cylinder to allow the displacer to reciprocate inside the cylinder. However, if the refrigerant gas passes through this gap to flow directly between the room temperature space and the expansion space, the cooling efficiency is reduced because of the absence of cooling by the regenerator material. As an example, this may be prevented by providing a sealing mechanism that prevents a flow of the refrigerant gas in the gap between the cylinder and the displacer. In general, an O-ring is used as this sealing mechanism.

However, this type of sealing mechanism may degrade over time to reduce its sealability. In this case, with this type of sealing mechanism, a desired refrigeration capacity cannot be achieved. Therefore, it has been proposed to form a helical groove on the outer peripheral (circumferential) surface of the displacer instead of providing a sealing mechanism such as an O-ring. (See, for example, Japanese Patent No. 2659684.)

SUMMARY

According to an aspect of the present invention, a cryogenic refrigerator includes a cylinder; a displacer accommodated in the cylinder so as to reciprocate inside the cylinder with a gap formed between a periphery of the displacer and an interior surface of the cylinder; and a depressed part formed on at least one of the periphery of the displacer and the interior surface of the cylinder, wherein a ratio of a volume of the depressed part to a volume of the gap satisfies a condition of $8 \leq Vd/Vg \leq 75$, where Vd is the volume of the depressed part and Vg is the volume of the gap.

The object and advantages of the invention will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION

As described above, it has been proposed to form a helical groove on the outer peripheral surface of the displacer instead of providing a sealing mechanism in view of a possible degradation of the sealability of the sealing mechanism over time.

By forming a helical groove on the outer peripheral surface of the displacer instead of providing a sealing mechanism it is possible to reduce heat loss to some extent and thereby to improve refrigeration performance. However, there is a demand for refrigerators of higher refrigeration performance.

Accordingly, it is desirable to provide a cryogenic refrigerator that is improved in refrigeration performance with reduced heat loss.

Next, a description is given, with reference to the accompanying drawings, of one or more embodiments of the present invention.

Figure 1:
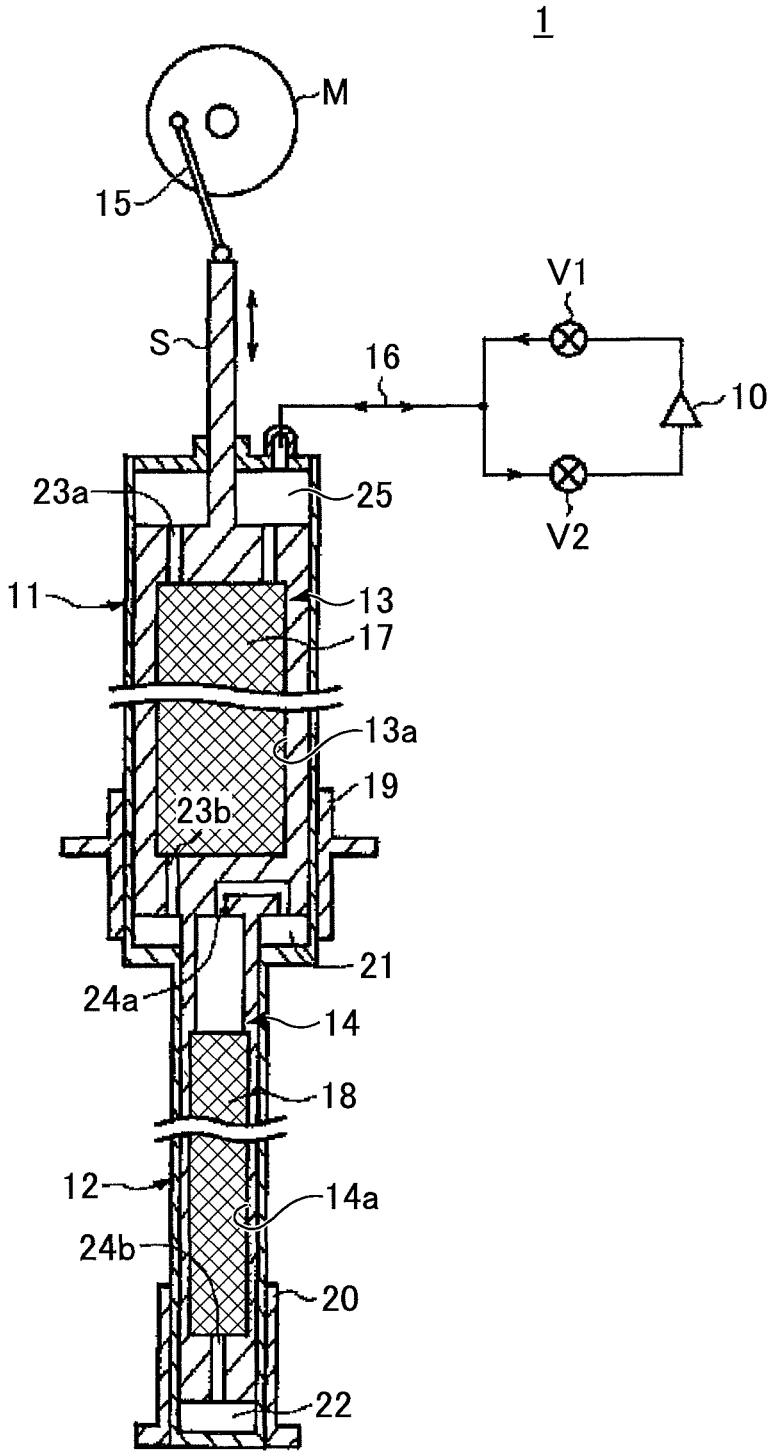
FIG. 1 is a schematic diagram illustrating a cryogenic refrigerator that is an embodiment of the present invention.

FIG. 1 is a diagram illustrating a cryogenic refrigerator including a displacer that is an embodiment of the present invention. In the following, a description is given, taking a GM refrigerator 1 as an example of the cryogenic refrigerator including a displacer. However, embodiments of the present invention are not only applied to GM refrigerators but may also be applied to other cryogenic refrigerators including a displacer, such as Stirling cycle refrigerators.

The GM refrigerator 1, which is a two-stage GM refrigerator, includes a compressor 10, a first-stage cylinder 11, a second-stage cylinder 12, a first-stage displacer 13, a second-stage displacer 14, and regenerator materials 17 and 18.

The compressor 10 generates a high-pressure refrigerant gas by compressing a refrigerant gas (helium gas). This high-pressure refrigerant gas is supplied into the first-stage cylinder 11 via a supply valve V1 and a gas passage 16.

The second-stage cylinder 12 is joined to the bottom of the first-stage cylinder 11. The first-stage displacer 13 is housed inside the first-stage cylinder 11 in such a manner as to be able to reciprocate vertically (upward and downward in FIG. 1) in the first-stage cylinder 11. The second-stage displacer 14 is housed inside the second-stage cylinder 12 in such a manner as to be able to reciprocate vertically (upward and downward in FIG. 1) in the second-stage cylinder 12. A shaft member S extends upward from the upper end of the first-stage displacer 13 to be joined to a crank mechanism 15 joined to a driving motor M.

A room temperature space 25 is formed between the upper end of the first-stage displacer 13 and an upper part of the first-stage cylinder 11. A first-stage expansion space 21 is formed between the lower end of the first-stage displacer 13 and the bottom of the first-stage cylinder 11. Further, a second-stage expansion space 22 is formed between the lower end of the second-stage displacer 14 and the bottom of the second-stage cylinder 12.

A space 13*a* is formed inside the first-stage displacer 13 and is filled with the first-stage regenerator material 17. Further, a gas passage 23*a* that connects the room temperature space 25 and the space 13*a* is formed in a high-temperature end portion of the first-stage displacer 13. Further, a gas passage 23*b* that connects the space 13*a* and the first-stage expansion space 21 is formed in a low temperature end portion of the first-stage displacer 13. Therefore, the room temperature space 25 and the first-stage expansion space 21 communicate with each other via the gas passage 23*a*, the space 13*a*, and the gas passage 23*b*.

A space 14*a* is formed inside the second-stage displacer 14 and is filled with the second-stage regenerator material 18. Further, a gas passage 24*a* that connects the first-stage expansion space 21 and the space 14*a* is formed in a high-temperature end portion of the second-stage displacer 14. Further, a gas passage 24*b* that connects the space 14*a* and the second-stage expansion space 22 is formed in a low temperature end portion of the second-stage displacer 14. Therefore, the first-stage expansion space 21 and the second-stage expansion space 22 communicate with each other via the gas passage 24*a*, the space 14*a* and the gas passage 24*b*.

Further, a first-stage heat station 19 is thermally coupled to a lower portion of the first-stage cylinder 11, and a second-stage heat station 20 is thermally coupled to a lower portion of the second-stage cylinder 12.

In the GM refrigerator 1 having the above-described configuration, when the supply valve V1 is opened and a return valve V2 is closed, the high-pressure refrigerant gas is supplied from the compressor 10 into the room temperature space 25 via the supply valve V1 and the gas passage 16. Then, the high-pressure refrigerant gas is supplied into the first-stage expansion space 21 through the gas passage 23*a*, the first-stage regenerator material 17, and the gas passage 23*b*.

The high-pressure refrigerant gas inside the first-stage expansion space 21 is further supplied into the second-stage expansion space 22 through the gas passage 24*a*, the second-stage regenerator material 18, and the gas passage 24*b*. The gas passages 23*a* and 24*a* are functionally illustrated in order to describe the flow of a refrigerant gas, and their actual structures are different from those illustrated.

When the supply valve V1 is closed and the return valve V2 is opened, the high-pressure refrigerant gas is returned to the compressor 10 through the above-described flow passages 24*b*, 24*a*, 23*b*, and 23*a*.

Next, a description is given of an operation of the GM refrigerator 1 having the above-described configuration.

When the GM refrigerator 1 is in operation, the first-stage displacer 13 and the second-stage displacer 14 are caused to vertically reciprocate as illustrated with arrows in FIG. 1 by the rotations of the driving motor M.

When the first-stage displacer 13 and the second-stage displacer 14 are at or near their respective bottom dead centers, the supply valve V1 is opened. As a result, the high-pressure refrigerant gas is supplied into the first-stage cylinder 11 and the second-stage cylinder 12 as described above.

The first-stage displacer 13 and the second-stage displacer 14 are caused to move upward by the driving motor M while this high-temperature refrigerant gas continues to be supplied. As a result, the volumes of the first-stage expansion space 21 and the second-stage expansion space 22 increase while the refrigerant gas in the first-stage cylinder 11 and the second-stage cylinder 12 are kept in a high-pressure state.

Then, when the first-stage displacer 13 and the second-stage displacer 14 arrive at or near their respective top dead centers, the supply valve V1 is closed and the return valve V2 is opened. As a result, the high-pressure refrigerant gas in the first-stage expansion space 21 and the second-stage expansion space 22 adiabatically expands to produce cold temperatures in the first-stage expansion space 21 and the second-stage expansion space 22.

The refrigerant gas, whose pressure has been reduced because of expansion, is returned to the compressor 10 through the second-stage regenerator material 18 provided in the second-stage displacer 14 and the first-stage regenerator material 17 provided in the first-stage displacer 13 with the downward movements of the first-stage displacer 13 and the second-stage displacer 14. At this point, the refrigerant gas, whose temperature has been lowered by the generated cold temperatures, cools the first-stage regenerator material 17 and the second-stage regenerator material 18 when passing through the first-stage regenerator material 17 and the second-stage regenerator material 18.

Accordingly, when a high-pressure refrigerant gas is supplied from the compressor 10 into the first-stage expansion space 21 and the second-stage expansion space 22 in the next supply process, the refrigerant gas is cooled by passing through the first-stage regenerator material 17 and the second-stage regenerator material 18. Accordingly, it is possible to improve the refrigeration performance of the GM refrigerator 1 by providing the first-stage regenerator material 17 and the second-stage regenerator material 18.

Figure 2:
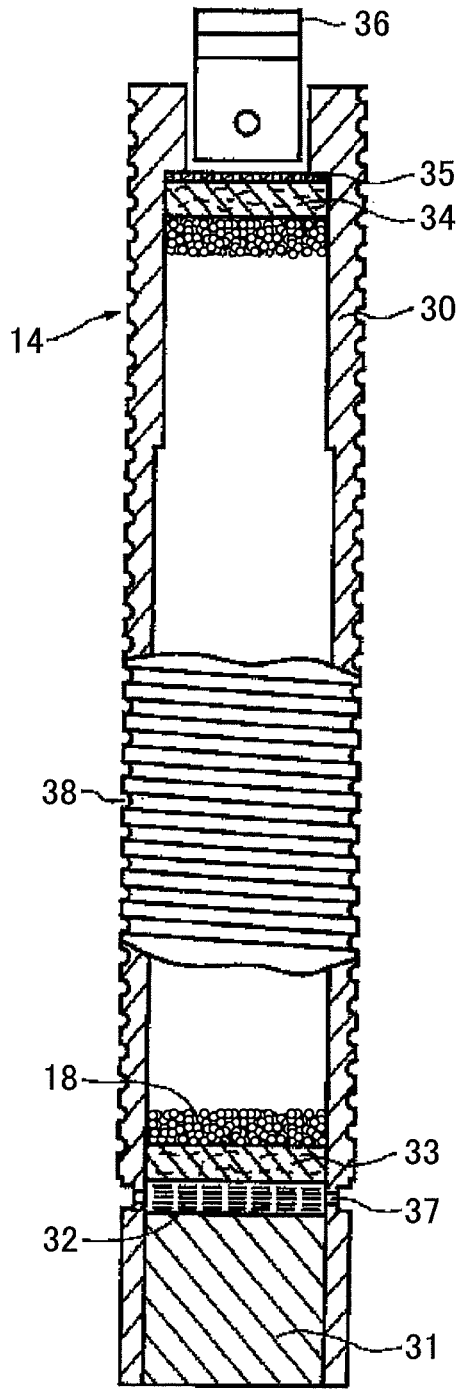
FIG. 2 is a cross-sectional view of part of a second-stage displacer of the cryogenic refrigerator that is an embodiment of the present invention.

FIG. 2 is an enlarged view of the second-stage displacer 14 of the GM refrigerator 1 illustrated in FIG. 1. The second-stage displacer 14 includes a tubular member 30 that serves as a body part. The tubular member 30 has a cylindrical shape that is open at the upper end and the lower end.

Further, a lid member 31, which is formed of fabric-containing phenol, is inserted into and bonded to the tubular member 30 at its lower end. A wire mesh 32 is placed on the lid member 31, and a felt plug 33 is placed on the wire mesh 32. Openings 37, which form the gas passage 24*b*, are formed at positions as high as the position of the wire mesh 32 in the tubular member 30.

Further, the second-stage regenerator material 18 is placed on the felt plug 33. A felt plug 34 is placed on the second-stage regenerator material 18. Thus, the second-stage regenerator material 18 fills in the space between the felt plugs 33 and 34 in the tubular member 30. A perforated metal 35 is placed on the felt plug 34. The perforated metal 35 is fixed by a step provided circumferentially on an upper part of the internal surface of the tubular member 30. A joining mechanism 36 for joining the second-stage displacer 14 to the first-stage displacer 13 is attached to the upper end of the tubular member 30.

Further, a depressed part is formed on the outer peripheral (circumferential) surface of the tubular member 30 of the second-stage displacer 14. In this embodiment, a helical groove part 38 is formed as this depressed part. The groove part 38 may be formed substantially entirely over the outer peripheral surface of the tubular member 30 from its high temperature end to its low temperature end. Alternatively, the groove part 38 may be formed on part of the outer peripheral surface of the tubular member 30.

Further, the shape of the groove part 38 is not limited to the helical shape as illustrated in this embodiment, and the groove part 38 may be formed of multiple annular (circular) grooves that are perpendicular to an axial direction of the second-stage displacer 14. Further, the shape of the depressed part is not limited to a continuous groove, and the depressed part may be formed of discrete depressions such as dimples.

The outer diameter of the tubular member 30 of the second-stage displacer 14 is slightly smaller than the inner diameter of the second-stage cylinder 12. Therefore, there is a gap 40 formed between the internal surface of the second-stage cylinder 12 and the outer peripheral surface of the second-stage displacer 14.

Figure 3:
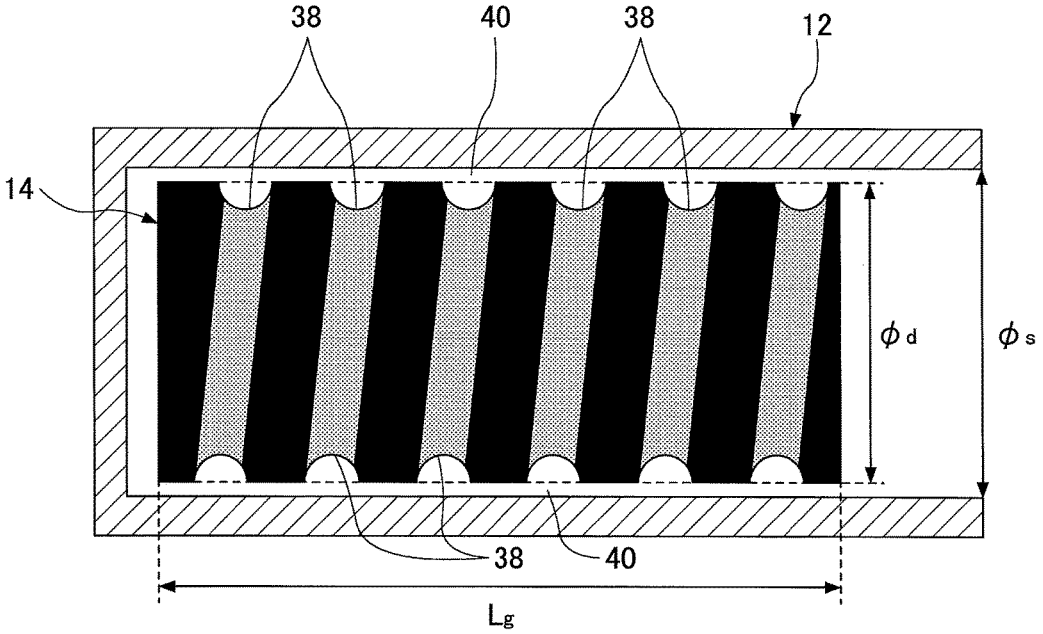
FIG. 3 is a diagram for illustrating the ratio of the volume of a groove part and the volume of a gap in a displacer where the groove part is formed entirely over its outer peripheral surface.
Figure 4:
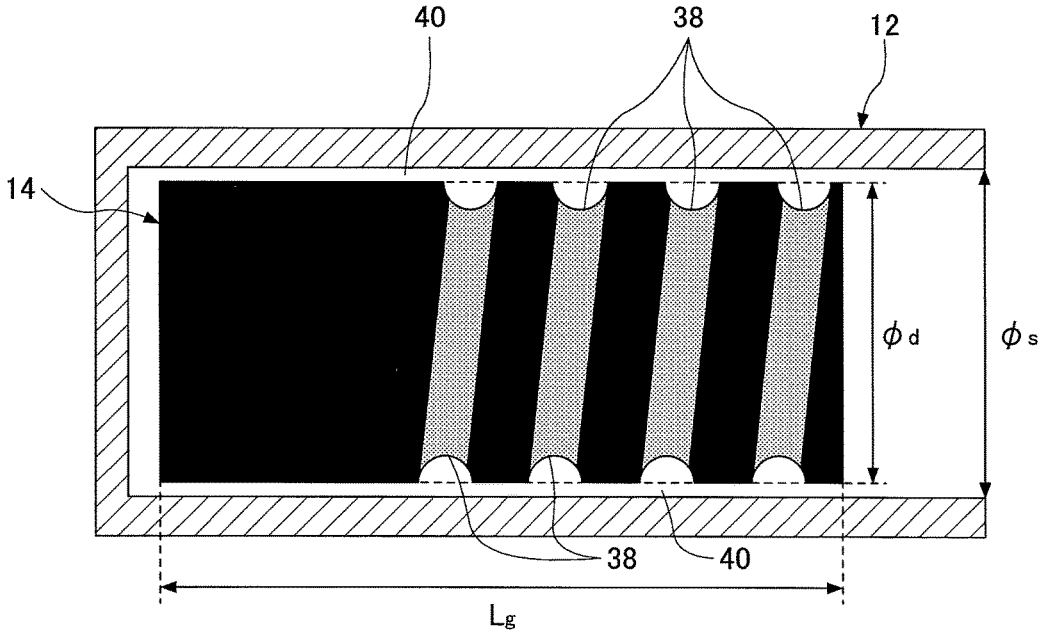
FIG. 4 is a diagram for illustrating the ratio of the volume of a groove part and the volume of a gap in a displacer where the groove part is formed over only a part of its outer peripheral surface.

A description is given, with reference to FIG. 3 and FIG. 4, of this configuration. FIG. 3 and FIG. 4 are schematic diagrams illustrating the second-stage cylinder 12 and the second-stage displacer 14 illustrated in FIG. 1. FIG. 3 illustrates a case where the groove part 38 is formed entirely over the second-stage displacer 14. FIG. 4 illustrates a case where the groove part 38 is formed in only a part of the second-stage displacer 14.

As described above, the outer diameter $\phi d$ of the second-stage displacer 14 (hereinafter referred to as the "displacer outer diameter $\phi d$") is slightly smaller than the inner diameter $\phi s$ of the second-stage cylinder 12 (hereinafter referred to as the "cylinder inner diameter $\phi s$") ($\phi d \leq \phi s$). Therefore, the gap 40 is formed between the second-stage cylinder 12 and the second-stage displacer 14.

This gap 40 is in contact with the groove part 38 formed on the periphery of the second-stage displacer 14. Further, no sealing mechanism such as an O-ring is provided between the second-stage cylinder 12 and the second-stage displacer 14.

Therefore, when the refrigerant gas is supplied from the compressor 10 to the second-stage expansion space 22 and when the refrigerant gas is returned from the second-stage expansion space 22 into the compressor 10, the refrigerant gas is divided to a first portion that flows through a regular gas passage (hereinafter referred to as the "first or primary passage") passing through the second-stage regenerator material 18 (the space 14*a*) provided (formed) inside the second-stage displacer 14 and a second portion that flows through a gas passage (hereinafter referred to as the "second or secondary passage") passing through the gap 40. That is, the refrigerant gas branches off to flow through both the primary passage and the secondary passage.

For example, when the refrigerant gas is supplied from the compressor 10 to the second-stage expansion space 22, the refrigerant gas that flows through the gap 40 forming the secondary passage enters the groove part 38 (helical groove) formed on the outer peripheral surface of the second-stage displacer 14 to be mixed with a refrigerant gas present in the groove part 38.

The second-stage displacer 14 is cooled by the second-stage regenerator material 18 provided inside the second-stage displacer 14. Therefore, the refrigerant gas in the groove part 38 is also cooled. The refrigerant gas that enters the groove part 38 from the gap 40 is cooled by being mixed with the refrigerant gas in the groove part 38. Then, the refrigerant gas cooled by the groove part 38 returns from the groove part 38 to the gap 40 to be supplied into the second-stage expansion space 22.

When the refrigerant gas that has adiabatically expanded in the second-stage expansion space 22 and decreased in temperature is returned to the compressor 10 as well, the refrigerant gas that flows through the gap 40 forming the secondary passage enters the groove part 38 to be mixed with a refrigerant gas present in the groove part 38. The refrigerant gas in the groove part 38 is cooled by being mixed with the refrigerant gas lowered in temperature because of its adiabatic expansion.

As a result, the second-stage displacer 14 is cooled, so that the second-stage regenerator material 18 inside the second-stage displacer 14 is also cooled. Then, the refrigerant gas subjected to heat exchange in the groove part 38 returns to the gap 40 to be supplied into the first-stage expansion space 21.

By forming the groove part 38 (depressed part) having a certain groove volume on the outer peripheral surface of the second-stage displacer 14 as described above, it is possible to cause a refrigerant gas to be present in the groove part 38. By causing the amount of a refrigerant gas inside this groove part 38 to be within a predetermined range relative to the amount of a refrigerant gas flowing through the gap 40, the refrigerant gas flowing through the gap 40 is allowed to suitably mix and perform heat exchange with the refrigerant gas present in the groove part 38.

Accordingly, by providing the groove part 38 on the second-stage displacer 14, it is possible to reduce heat loss compared with the case of letting a refrigerant gas directly communicate between expansion spaces without a groove part on the displacer.

However, if there is a change in the volume of the gap 40 and in the volume of the groove part 38, there may be a change in the state of mixture of a refrigerant gas flowing through the gap 40 and a refrigerant gas inside the groove part 38, so that a change may be caused in the heat exchangeability between the refrigerant gases.

Therefore, the inventors of the present invention have focused on the ratio of the volume Vd of the groove part 38 to the volume Vg of the gap 40 (the volume ratio Vd/Vg), and have conducted a simulation to determine refrigerating temperatures that may be achieved by the GM refrigerator 1 in the case of changing the volume ratio Vd/Vg.

Because the gap 40 is extremely small compared with the displacer outer diameter $\phi d$ and the cylinder inner diameter $\phi s$, letting the length of the second-stage displacer 14 be Lg, the volume Vg of the gap 40 may be determined by the following equation:

$$Vg=(\phi s-\phi d)/2\times\pi\times\phi s\times Lg.$$

Even when the groove part 38 is not formed entirely over the second-stage displacer 14 as illustrated in FIG. 4, the length Lg is the overall length of the second-stage displacer 14.

Further, the volume Vd of the groove part 38 may be determined from the following equation:

$$Vd=Sd\times Ld,$$

where Sd is the cross-sectional area of the groove part 38 and Ld is the length of the groove part 38.

Accordingly, the volume ratio Vd/Vg of the volume Vd of the groove part 38 and the volume Vg of the gap 40 may be determined by the following equation:

$$Vd/Vg=(Sd\times Ld)/\{(\phi s-\phi d)/2\times\pi\phi s\times Lg\}.$$

Figure 5:
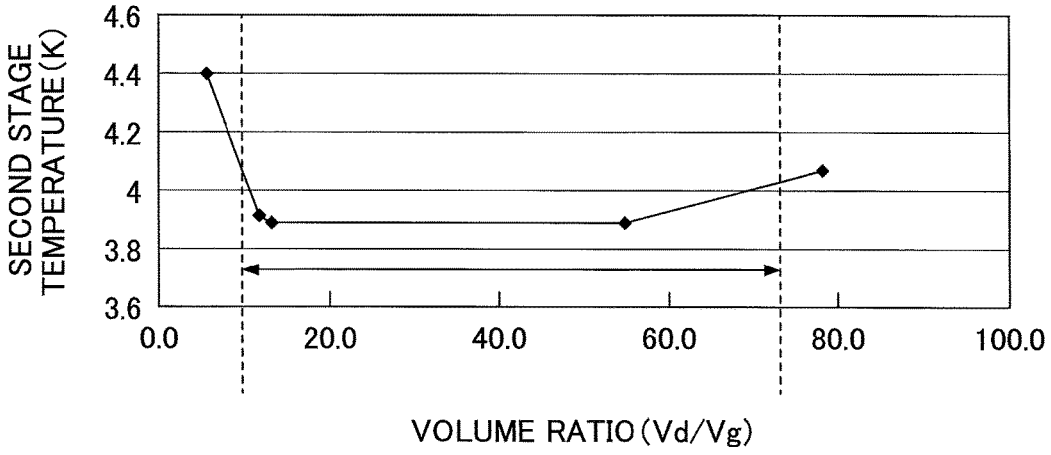
FIG. 5 is a graph illustrating the relationship between the ratio of the volume of a groove part to the volume of a gap and refrigeration performance.

FIG. 5 illustrates the results of the simulation for determining refrigerating temperatures that may be achieved by the GM refrigerator 1 in the case of changing the volume ratio Vd/Vg. In FIG. 5, the horizontal axis represents the volume ratio Vd/Vg of the volume Vd of the groove part 38 and the volume Vg of the gap 40, and the vertical axis represents the achieved refrigerating temperatures.

As illustrated in FIG. 5, the cooling temperature, at which the performance of the GM refrigerator 1 is the best, is 3.85 K. Further, the range of volume ratios in which this best performance is obtained is $16\leq Vd/Vg\leq 54$. Further, the GM refrigerator 1 may have a minimum capability required to maintain its performance when the degree of degradation is 5% or less at a cooling temperature of approximately 3.85 K. Therefore, the refrigeration performance may be kept good by setting the volume ratio Vd/Vg within the range of $8\leq Vd/Vg\leq 75$.

Thus, the simulation results of FIG. 5 demonstrate that by setting the volume ratio Vd/Vg to be more than or equal to 8 and less than or equal to 75, it is possible to optimize the volume Vd of the groove part 38 and the volume Vg of the gap 40 (that is, the volume of the secondary passage) and to have the GM refrigerator 1 operating with high efficiency.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

Figure 6:
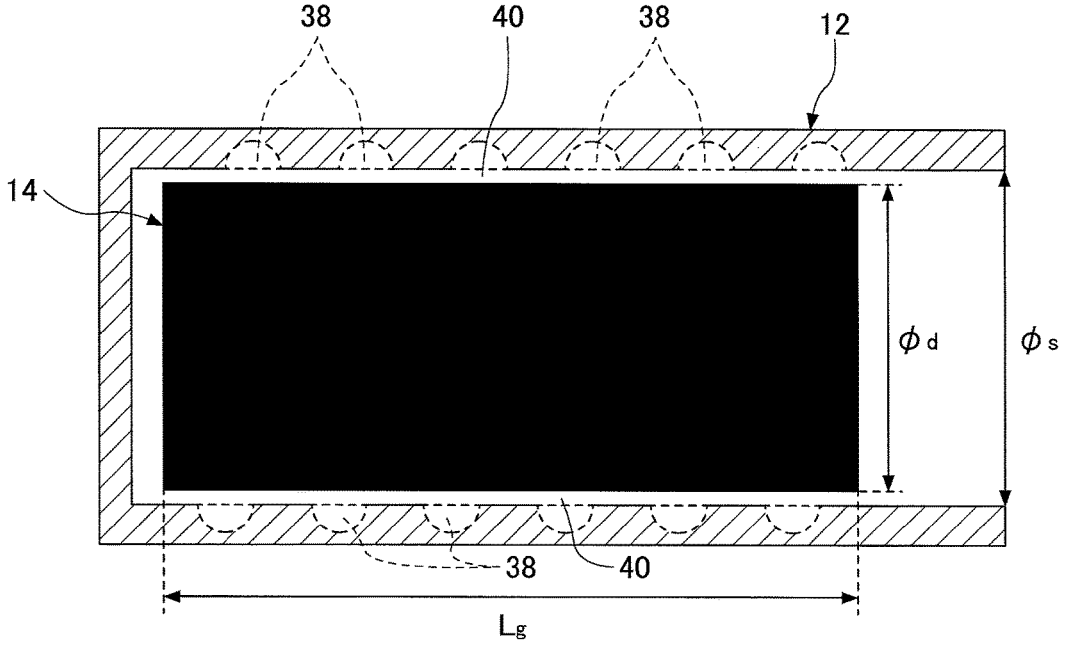
FIG. 6 is a diagram illustrating a configuration where a groove part is formed entirely over the interior surface of a cylinder.

For example, the above description is given of the case where a groove part is formed on the outer peripheral surface of a displacer, while a groove part may alternatively be provided on the interior surface of a cylinder as illustrated in FIG. 6, for example, where the groove part 38 is formed entirely on the interior surface of the second-stage cylinder 12. Further, a groove part may also be provided on both the outer peripheral surface of a displacer and the interior surface of a cylinder.

What is claimed is:

1. A cryogenic refrigerator, comprising:

a cylinder;

a displacer accommodated in the cylinder so as to reciprocate inside the cylinder with a gap formed between a periphery of the displacer and an interior surface of the cylinder; and a depressed part formed on at least one of the periphery of the displacer and the interior surface of the cylinder, wherein a ratio of a volume of the depressed part to a volume of the gap satisfies a condition of $16\leq Vd/Vg\leq 54$, where Vd is the volume of the depressed part and Vg is the volume of the gap, and wherein Vd is determined from $Vd=Sd\times Ld$, where Sd is a cross-sectional area of the depressed part and Ld is a length of the depressed part.

2. The cryogenic refrigerator as claimed in claim 1, wherein the depressed part is a groove.

3. The cryogenic refrigerator as claimed in claim 1, wherein the depressed part is helically formed.

4. The cryogenic refrigerator as claimed in claim 1, wherein the displacer includes a first passage through which the refrigerant gas flows, and wherein the gap and the depressed part form a second passage through which the refrigerant gas flows on the periphery of the displacer.

5. The cryogenic refrigerator as claimed in claim 1, wherein the groove part is formed on only a part of the at least one of the periphery of the displacer and the interior surface of the cylinder.

* * * * *